US007967171B2

(12) United States Patent
Foster et al.

(10) Patent No.: US 7,967,171 B2
(45) Date of Patent: Jun. 28, 2011

(54) AIR FOAMING PUMP TRIGGER SPRAYER

(75) Inventors: Donald D. Foster, St. Charles, MO (US); Philip L. Nelson, Wildwood, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 1674 days.

(21) Appl. No.: 10/961,954

(22) Filed: Oct. 11, 2004

(65) Prior Publication Data

US 2006/0086762 A1 Apr. 27, 2006

(51) Int. Cl.
*B67D 7/58* (2010.01)

(52) U.S. Cl. ..... 222/383.1; 222/481.5; 239/333

(58) Field of Classification Search ..... 222/321.7, 222/321.9, 383.1, 481.5; 239/333
See application file for complete search history.

(56) References Cited

U.S. PATENT DOCUMENTS

| | | | | |
|---|---|---|---|---|
| 4,230,277 | A | 10/1980 | Tada | |
| 4,819,835 | A | 4/1989 | Tasaki | |
| 4,958,754 | A | 9/1990 | Dennis | |
| 5,570,840 | A | 11/1996 | Gettinger et al. | |
| 5,806,724 | A * | 9/1998 | Foster | 222/383.1 |
| 5,996,847 | A * | 12/1999 | Smolen et al. | 222/137 |
| 6,641,003 | B1 | 11/2003 | Foster et al. | |
| 6,644,516 | B1 | 11/2003 | Foster et al. | |
| 6,840,408 | B1 | 1/2005 | Foster et al. | |
| 7,306,122 | B2 * | 12/2007 | Stark et al. | 222/383.1 |

FOREIGN PATENT DOCUMENTS

| | | |
|---|---|---|
| EP | 0706830 | 4/1996 |
| WO | WO2004054723 | 7/2004 |

* cited by examiner

*Primary Examiner* — Frederick C. Nicolas
(74) *Attorney, Agent, or Firm* — MWV Intellectual Property Group

(57) ABSTRACT

A manually operated liquid foaming dispenser is attached to the top of a container of liquid and is manually reciprocated to dispense the liquid from the container as a foam. The dispenser includes a liquid pump chamber and an air pump chamber that respectively pump liquid and air under pressure to a discharge passage of the pump where the liquid and air are mixed, generating the foam dispensed from the dispenser. The air pump chamber has a tube valve controlling the discharge of air from the air pump to the discharge passage, and the air pump chamber is charged with air by opening the air pump chamber to the exterior environment of the dispenser.

20 Claims, 3 Drawing Sheets

AIR FOAMING PUMP TRIGGER SPRAYER

BACKGROUND OF THE INVENTION (1) Field of the Invention

The present invention pertains to a manually operated liquid foaming dispenser. Specifically, the invention pertains to a manually operated trigger sprayer that is attached to the top of a bottle of liquid and has a manually manipulated trigger that is reciprocated to dispense the liquid from the container as a foam. The trigger sprayer includes a liquid pump chamber and an air pump chamber that respectively pump liquid and air under pressure to a discharge passage of the sprayer where the liquid and air are mixed, generating the foam dispensed from the sprayer.

(2) Field of the Invention

Manually operated liquid dispensers that dispense liquid as a foam are known in the prior art. Common among these types of dispensers are manually operated trigger sprayers that pump liquid from a bottle container attached to the trigger sprayer and dispense the liquid as a foam that is discharged from the trigger sprayer. The dispensing nozzle of this type of trigger sprayer typically discharges the liquid as a spray toward an obstruction that is vented to the atmosphere. The spray hitting the obstruction mixes the liquid spray with the air of the atmosphere producing the foam that is discharged from the trigger sprayer.

The typical trigger sprayer that discharges a foam is constructed of a sprayer housing containing a pump chamber, a liquid supply passage, and a liquid discharge passage. The liquid supply passage communicates the pump chamber with the liquid contained in the container attached to the trigger sprayer. A pump piston is mounted in the pump chamber for reciprocating movement between charge and discharge positions. A trigger is attached to the sprayer housing and is connected to the pump piston for moving the pump piston. The pump chamber also communicates with the liquid discharge passage which extends from the pump chamber to the discharge nozzle of the trigger sprayer.

A first check valve assembly is positioned between the pump chamber and the liquid supply passage. The first check valve allows liquid to travel through a dip tube and the liquid supply passage into the pump chamber when the pump piston is moved to the charge position, and prevents the reverse flow of liquid from the pump chamber when the pump piston is moved to the discharge position. A second check valve is usually positioned in the discharge passage between the pump chamber and the discharge nozzle. The additional check valve assembly allows the flow of liquid from the pump chamber through the discharge passage to the discharge nozzle when the pump piston is moved to the discharge position, but prevents the reverse flow of liquid and/or air when the pump piston is moved to the charge position.

The basic construction of the foaming liquid trigger sprayer described above is well suited for dispensing liquids where the desired foaming of the liquid is marginal, for example in dispensing foaming liquid kitchen cleaners or bathroom cleaners. However, the foaming trigger sprayers cannot produce a more dense foam such as that of shaving cream.

To produce a more dense foam such as that of shaving cream from a liquid dispenser requires that both the liquid and air being mixed by the dispenser be under pressure. This requires that the manually operated foaming dispenser include both a liquid pump chamber and an air pump chamber. The addition of the air pump chamber to the manually operated dispenser increases the number of component parts of the dispenser. The air pump chamber must also have an air pump piston that moves between the charge and discharge positions in the air pump chamber to draw air into the chamber and force air under pressure from the chamber. In addition, the air pump chamber must also have a check valve assembly that allows the air of the exterior environment of the dispenser to flow into the air pump chamber when the air pump piston is moved to the charge position and prevents the flow of air from the air pump chamber to the exterior environment when the air pump piston is moved to the discharge position. A second check valve assembly is also needed to control the flow of pressurized air from the air pump chamber to the discharge passage when the air pump piston is moved to the discharge position, and to prevent the reverse flow of air from the discharge passage to the air pump chamber when the air pump piston is moved to the charge position. These additional component parts required by this type of liquid foaming dispenser significantly increase manufacturing costs.

SUMMARY OF THE INVENTION

The air foaming trigger sprayer of the present invention reduces manufacturing costs by reducing the number of separate component parts that are assembled into the trigger sprayer. More specifically, the trigger sprayer of the invention is constructed with a triple valve member, replacing three separate valves of prior art air foaming sprayers with a single member that performs the functions of three prior art valves.

The trigger sprayer has a sprayer housing that is similar to the sprayer housings of prior art trigger sprayers in that it comprises a pump chamber, a vent chamber, a liquid discharge passage and a liquid supply passage. A connector cap attaches the trigger sprayer housing to a separate bottle containing a liquid to be dispensed by the trigger sprayer. A portion of the liquid discharge passage and a portion of the liquid supply passage are formed as a single continuous passage that extends vertically upwardly through the sprayer housing from the bottom of the sprayer housing. The top of the continuous vertical passage communicates with the remainder of the discharge passage that extends to the nozzle assembly on the sprayer housing.

In addition, an air pump chamber is provided on the sprayer housing. The air pump chamber surrounds the liquid pump chamber. The coaxial arrangement of the liquid pump chamber and the air pump chamber give the air foaming trigger sprayer a compact construction.

A liquid pump piston is received in the liquid pump chamber for reciprocating movement between charge and discharge positions of the liquid pump piston in the liquid pump chamber. In addition, an air pump piston is mounted on the liquid pump piston and is received in the air pump chamber. The air pump piston moves with the liquid pump piston between charge and discharge positions of the air pump piston in the air pump chamber. The air pump piston is also mounted to the liquid pump piston for limited relative movement between the two pistons that enable venting of the air pump chamber when the air pump piston is moved to its charge position relative to the air pump chamber.

The liquid pump chamber communicates with the continuous passage through both an inlet passage and an outlet passage. The inlet passage and the outlet passage are spaced from each other along the continuous passage of the sprayer housing. The air pump chamber also communicates with the continuous passage of the sprayer housing through an outlet passage that communicates with the continuous passage.

The single valve member is inserted into the continuous passage of the sprayer housing and is positioned in the continuous passage between the liquid pump chamber inlet passage and the liquid pump chamber outlet passage. The single valve member has a cylindrical base that seats in the continuous passage of the sprayer housing between the liquid pump chamber inlet passage and the liquid pump chamber outlet passage and divides the continuous passage of the sprayer housing into the liquid discharge passage on one side of the valve member base and the liquid supply passage on the other side of the valve member base.

A pair of coaxial resilient sleeves or tube valves project upwardly from the valve member base. A first, inner sleeve engages against the interior surface of the liquid discharge passage and controls the flow of liquid out of the liquid pump chamber outlet passage. Thus, the first resilient tube valve functions as the check valve in the liquid discharge passage that allows liquid flow from the liquid pump chamber to the liquid discharge passage, but prevents the reverse flow of liquid.

The second, inner sleeve engages against the interior surface of the discharge passage and controls the flow of air out of the air pump chamber outlet passage. Thus, the second resilient tube valve also functions as a check valve in the discharge passage that allows air flow from the air pump chamber to the discharge passage, but prevents the reverse flow.

A stem projects downwardly from the center of the valve base and a resilient disk valve is provided on the distal end of the stem. The length of the stem positions the disk valve below the liquid pump chamber inlet passage in the liquid supply passage.

A cylindrical valve seat insert is inserted into the liquid supply passage below the disk valve. The valve seat insert has an annular peripheral surface that seats against a portion of the disk valve adjacent its peripheral surface. An interior bore extends through the valve seat insert and defines a portion of the liquid supply passage. The dip tube is inserted into the valve seat interior bore at the bottom of the valve seat. Thus, the disk valve seating against the annular peripheral surface of the valve seat insert functions as the check valve that allows liquid flow through the dip tube and the liquid supply passage to the liquid pump chamber, but prevents the reverse flow of liquid.

A manual trigger is attached to the exterior of the sprayer housing and is operatively connected to the liquid pump piston and the air pump piston to cause the pistons to reciprocate through their respective pump chambers on manual manipulation of the trigger. The reciprocation of the liquid pump piston between charge and discharge positions of the liquid pump piston in the liquid pump chamber draws liquid through the dip tube and unseats the disk valve allowing the liquid to be drawn through the liquid supply passage and the liquid pump chamber inlet passage into the liquid pump chamber. Reciprocation of the liquid pump piston also forces the liquid from the liquid pump chamber through the liquid pump chamber outlet passage displacing the first resilient tube valve from its engagement with the interior surface of the liquid discharge passage and pumping the liquid through the discharge passage. The reciprocation of the air pump piston between charge and discharge positions of the air pump piston in the air pump chamber allows air to be drawn into the air pump chamber. As the liquid pump piston moves toward its charge position, the air pump piston moves to a limited extent relative to the liquid pump piston causing an air vent passage to open. As the air pump piston moves toward its charge position in the air pump chamber, air from the exterior environment of the trigger sprayer is drawn through the air passage and into the air pump chamber. When the liquid pump piston is moved toward its discharge position in the liquid pump chamber, the air pump piston again moves relative to the liquid pump piston in an opposite direction, closing the air vent passage. Continued movement of the air pump piston toward its discharge position in the air pump chamber forces the air from the air pump chamber through the air pump chamber outlet displacing the second tube valve from its engagement with the interior surface of the discharge passage and mixing the air under pressure with the liquid in the discharge passage producing a foam that is discharged through the discharge orifice of the sprayer nozzle assembly.

The construction of the air foaming trigger sprayer described above with the single valve element having both a disk valve to control the liquid drawn into the liquid pump chamber and a pair of tube valves to control the discharge of the liquid from the liquid pump chamber and air from the air pump chamber reduces the component parts of prior art trigger sprayers by providing a single valve member with three valve elements. The mounting of the air pump piston for limited movement relative to the liquid pump piston to open an air passage also eliminates the need for an additional air vent valve in the trigger sprayer construction. This further reduces the number of component parts of the trigger sprayer. The reduction in the number of component parts that go into the assembly of the trigger sprayer reduces its manufacturing costs.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

The air foaming trigger sprayer of the invention is similar in construction to the trigger sprayer disclosed in U.S. Pat. No. 6,641,003 B1, assigned to the assignee of the present invention and incorporated herein by reference. Because many of the component parts of the trigger sprayer disclosed in the above-referenced patent are employed in the construction of the trigger sprayer of the invention, these common component parts will first be generally described.

Figure 3:
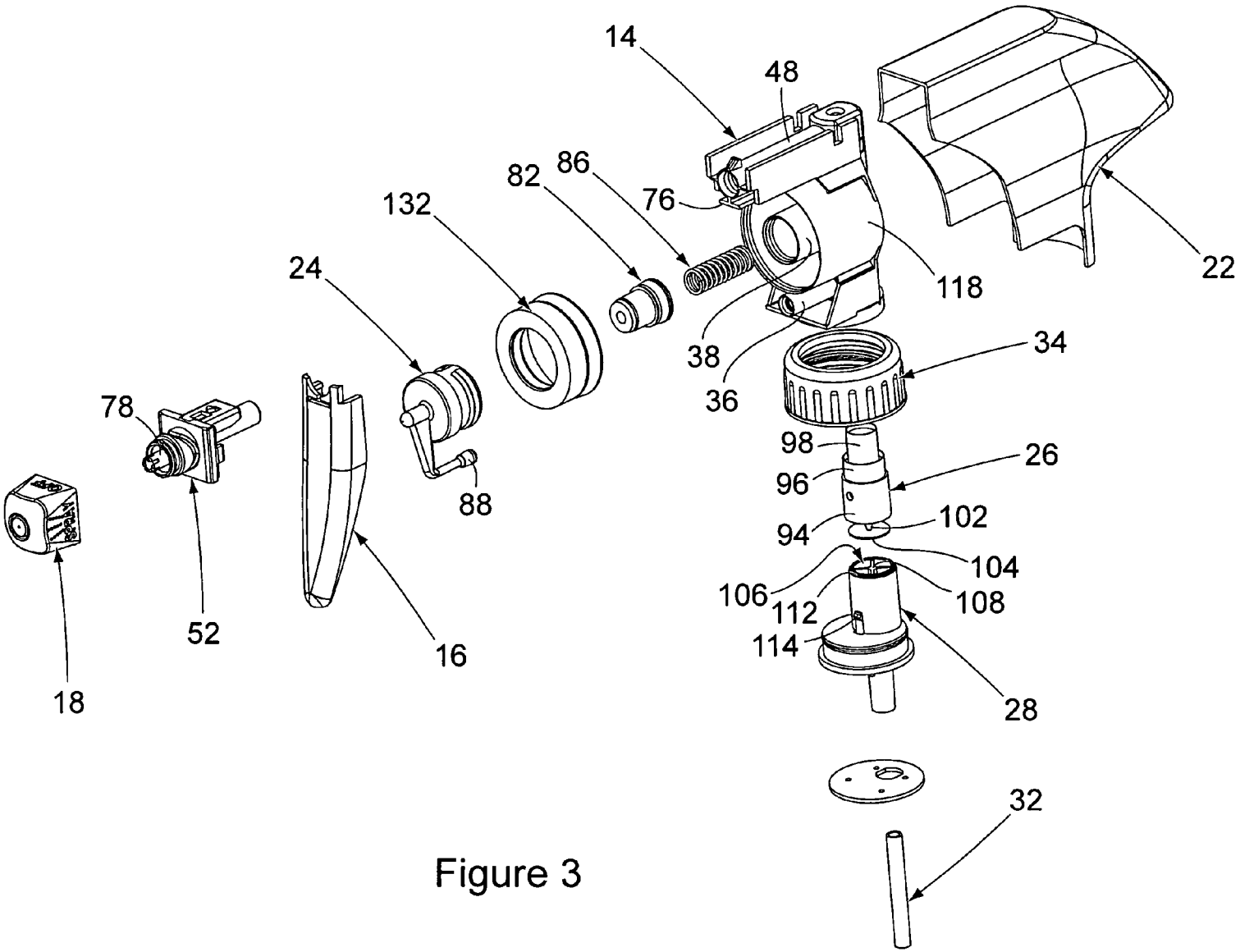

FIG. 3 shows the disassembled component parts of the trigger sprayer 12 that include the sprayer housing 14, the trigger 16, the discharge nozzle 18, the sprayer shroud 22, the liquid pump piston and vent piston assembly 24, the valve member 26, the valve seat insert 28 and the dip tube 32. Each of the component parts is constructed of a resilient plastic material, as is typical. However, the material employed in constructing the valve member 26 is more resilient and flexible than that of the other component parts of the trigger sprayer.

Figure 1:
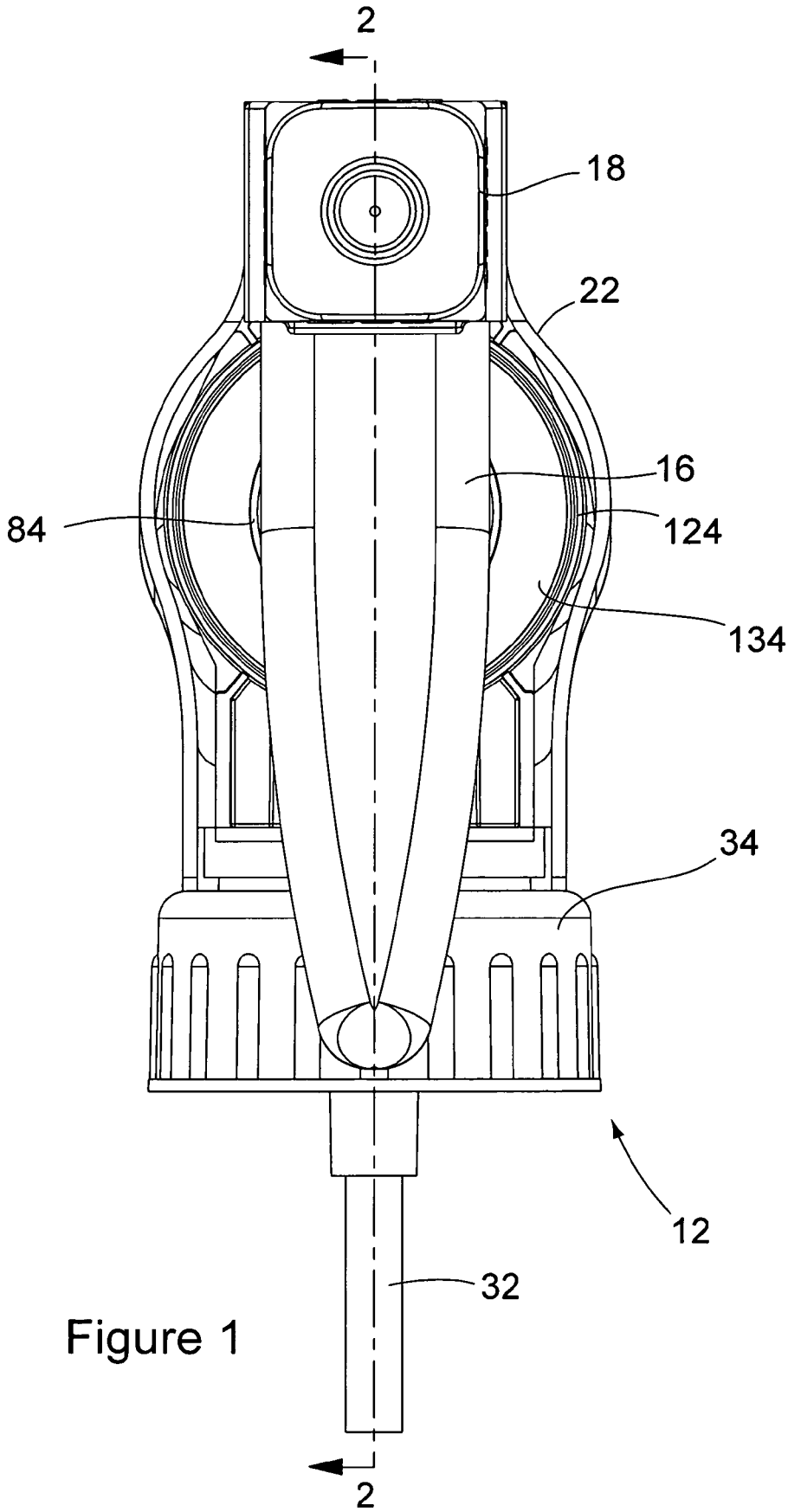
FIG. 1 is a front elevation view of the trigger sprayer of the invention.
Figure 2:
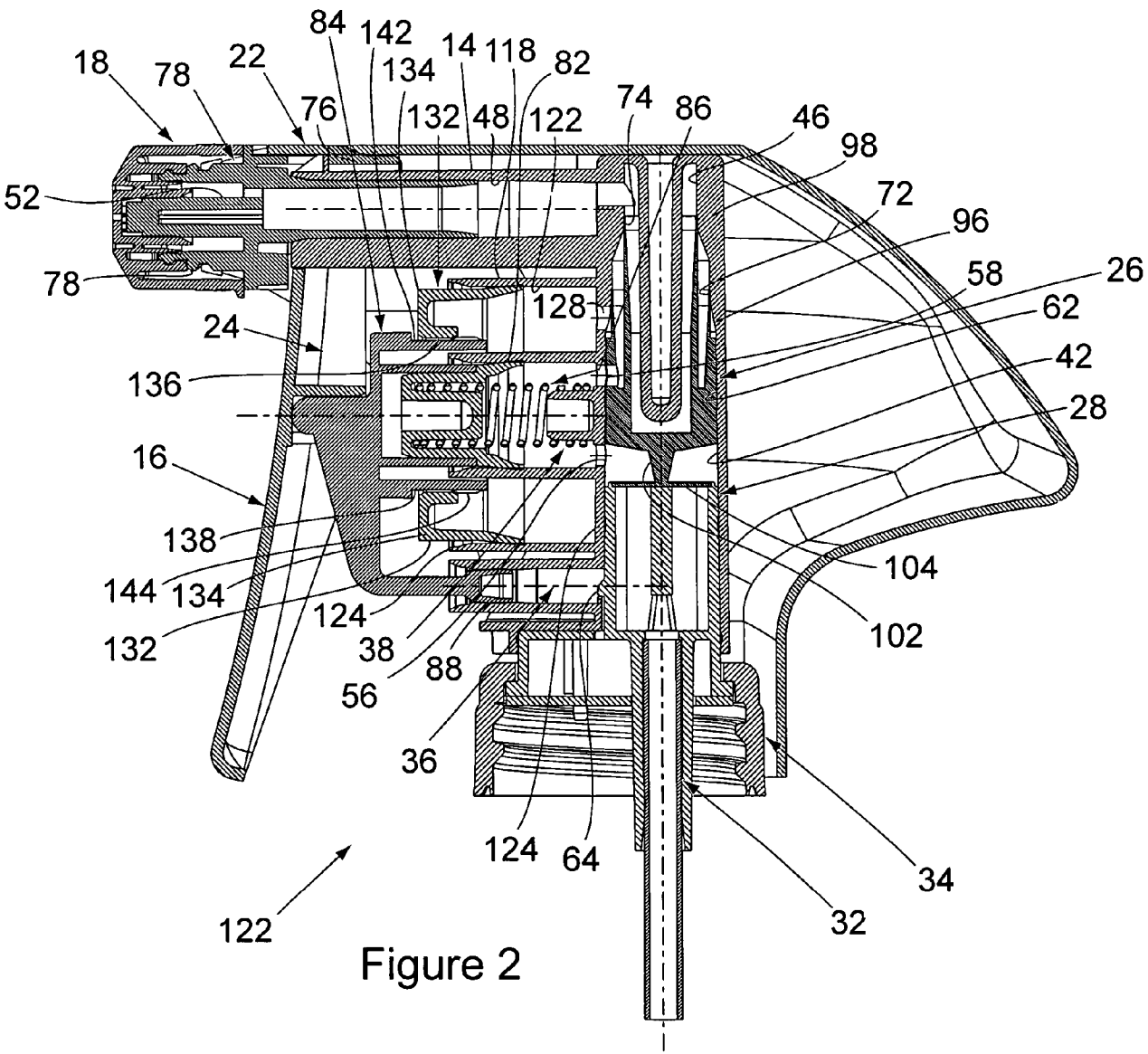
FIG. 2 is a side sectioned view of the trigger sprayer of the invention along the line 2-2 of FIG. 1; and, FIG. 3 is a perspective view of the disassembled component parts of the trigger sprayer.

Referring to FIGS. 1, 2 and 3, the sprayer housing 14 is connected to a separate liquid container (not shown) by a connector cap 34. The connector cap 34 is a separate component part that is mounted on the sprayer housing 14 for rotation of the cap relative to the sprayer housing. However, the connector cap 34 could be an integral part of the sprayer housing 14 to reduce the number of separate component parts of the trigger sprayer.

The interior of the sprayer housing 14 is formed with a cylindrical vent chamber 36, a cylindrical liquid pump chamber 38, a liquid supply passage with a cylindrical interior surface 42 and a liquid discharge passage that is comprised of a first, vertical section with a cylindrical interior surface 46 and a second horizontal section 48. The liquid supply passage 42 extends from an inlet opening in the sprayer housing to the liquid pump chamber 38 and the liquid discharge passage 46, 48 extends from the liquid pump chamber 38 to an outlet opening in the sprayer housing. A liquid spinner assembly 52 is provided at the outlet opening of the discharge passage second section 48. The construction of the spinner assembly 52, the discharge passage second section 48, the liquid pump chamber 38 and the vent chamber 36 are similar to those of prior art trigger sprayers.

The continuous passage formed by the liquid supply passage 42 and the first section of the liquid discharge passage 46 communicates with the interior of the liquid pump chamber 38 through a liquid pump chamber inlet passage 56 and a liquid pump chamber outlet passage 58. A portion of the passage 62 is positioned between the liquid pump chamber inlet passage 56 and the liquid pump chamber outlet passage 58. The continuous passage also communicates with the interior of the vent chamber 36 through a vent passage 64. The discharge passage first section 46 has a larger interior diameter portion 72 adjacent the liquid pump chamber outlet passage 58 and a smaller interior diameter portion 74 adjacent the discharge passage second section 48.

The exterior surface of the sprayer housing 14 is provided with features that attach the shroud 22. A pair of flanges 76 project downwardly from the opposite sides of the sprayer housing for mounting the trigger 16 to the sprayer housing. The housing has a cylindrical collar 78 that surrounds the outlet of the discharge passage 48. The collar 78 receives the discharge nozzle 18.

The piston assembly 24 is basically comprised of a liquid pump piston 82 that is mounted on a piston rod assembly 84. A vent piston 88 is formed as part of the rod assembly 84. The liquid pump piston 82 is mounted in the liquid pump chamber 38 for reciprocating movements between charge and discharge positions of the liquid pump piston relative to the liquid pump chamber. A coil spring 86 biases the liquid piston 82 toward the discharge position. The vent piston 88 is mounted in the vent chamber 36 for reciprocating movements between closed and opened positions of the vent piston 88 relative to the vent chamber 36. The functioning of the liquid pump piston 82 to pump liquid through the sprayer housing 14 is known in the art and will not be explained in detail. Additionally, the functioning of the vent piston 88 to vent the interior of a container attached to the sprayer housing 14 is known in the art and will not be explained in detail. The piston assembly 24 is connected to the trigger 16 for reciprocating movement of the piston assembly in response to pivoting movement of the trigger. The piston assembly 24 is clipped to the trigger 16 so that the piston assembly is pushed into the pump and vent chambers 38, 36 and pulled out of the pump and vent chambers in response to the pivoting movement of the trigger 16 relative to the sprayer housing 14.

The trigger 16 has a pair of pivot slots 92 at the top of the trigger. The slots 92 are assembled to the sprayer housing flanges 76 mounting the trigger 16 for pivoting movement on the housing 14.

The discharge nozzle 18 is mounted on the sprayer housing collar 78 for rotation of the nozzle. The discharge nozzle 18 is provided with interior axial grooves that align with and come out of alignment with axial grooves provided on the spinner assembly 52, as is known in the art. This enables the discharge nozzle 18 to be selectively moved between an "off" position and a "foam" position as is known in the prior art.

As stated earlier, the valve member 26 is constructed of a resilient plastic material that is slightly more flexible than the remaining component parts of the trigger sprayer 12. Referring to FIG. 1, the valve member is constructed with a cylindrical base 94. A first outlet valve element in the form of a resilient hollow tube or sleeve valve 96 projects outwardly from the valve base 94. The tube valve 96 has an exterior surface diameter dimension that is slightly larger than the interior diameter dimension of the large interior diameter portion 72 of the discharge passage. A second outlet valve element in the form of a resilient hollow tube or sleeve valve 98 projects outwardly from the valve base 94. The second sleeve valve 98 is concentric and contained inside the first sleeve valve 96. The second sleeve valve 98 has an exterior surface diameter dimension that is slightly larger than the interior diameter dimension of the small interior diameter portion 74 of the discharge passage. A valve stem 102 projects outwardly from the base 94 of the valve member. An inlet valve element in the form of a disk valve 104 is provided on the distal end of the stem 102.

The valve member 26 is assembled into the continuous passage of the sprayer housing 14 defined by the first section of the discharge passage 46 and the liquid supply passage 42. The valve member is positioned in the sprayer housing as shown in FIG. 2 with the valve member base 94 engaging against the annular interior surface 62 of the continuous passage. This positions the valve member base 94 between the liquid pump chamber inlet passage 56 and the liquid pump chamber outlet passage 58. In this position the valve member base 94 separates and seals the liquid supply passage 42 from the liquid discharge passage first section 46. In addition, the second sleeve valve 98 is positioned in the liquid passage second section 74 and engaging in sealing engagement with the small interior diameter portion 74 of the discharge passage. The stem 102 of the valve member positions the disk valve 104 in the supply passage 42 below the liquid pump chamber inlet passage 56.

The valve seat insert 28 shown in FIG. 5 has a cylindrical interior bore 106 that extends entirely through the insert. The dip tube 32 is inserted into the bore 106 at the bottom of the insert and the dip tube 32 and the insert interior bore 106 form a portion of the liquid supply passage leading to the liquid pump chamber inlet passage 56. A center column 108 is positioned in the center of the valve seat insert interior bore 106. A circular valve seating surface 112 extends around the valve seat bore 106. The circular valve seating surface 112 rises slightly above the end of the center column 108 as can best be seen in FIG. 2. A cylindrical exterior surface of the valve seat insert 28 is provided with an outwardly projecting tab 114.

As shown in FIG. 2, the valve seat insert 28 is assembled into the sprayer housing 14 by being inserted upwardly through the liquid supply passage 42 from the bottom of the sprayer housing. The insert 28 is inserted after the valve member 26 has been assembled into the sprayer housing 14. The insert 28 is pushed upwardly through the liquid supply passage 42 until the projecting tab 114 on the insert exterior surface engages in the vent chamber opening in the vent passage 64. This secures the valve seat insert 28 in the liquid supply passage 42. In this position of the valve seat insert 28 the center column 108 of the insert engages against the center of the disk valve 104 and the circular seating surface 112 of the insert engages against a peripheral portion of the disk valve 104 and pushes the disk valve peripheral portion slightly upwardly as shown in FIG. 2. This provides a sealing engagement between the insert circular seating surface 112 and the peripheral portion of the disk valve 104.

In addition to the vent chamber 36 and liquid pump chamber 38, the trigger sprayer of the invention includes an air pump chamber 118 on the sprayer housing 14. The air pump chamber 118 includes a cylindrical side wall 122 that extends outwardly from the sprayer housing 14. The side wall 122 completely surrounds and contains the liquid pump chamber 38. Thus, the air pump chamber 118 and liquid pump chamber 138 are coaxial. The air pump chamber side wall 122 extends outwardly from a cylindrical end wall 124 of the air pump chamber, to a circular distal end 126 of the side wall. An air pump outlet passage 128 passes through the pump chamber end wall 124 and communicates the interior volume of the air pump chamber 118 with the discharge passage 46.

An air pump piston 132 is mounted in the air pump chamber 118 for reciprocating movements between charge and discharge positions of the air pump piston relative to the air pump chamber. The air pump piston 132 has a cylindrical exterior surface 134 that engages in a sealing, sliding contact with an interior surface of the air pump chamber side wall 122. The air pump piston also has an annular end wall 134 and a cylindrical collar 136 that surrounds a center opening of the end wall. The piston collar 136 surrounds a cylindrical extension 138 of the piston rod assembly 184. An interior diameter dimension of the air piston collar 136 is slightly larger than an exterior diameter dimension of the piston rod extension 138, enabling the collar 136 and the air pump piston 132 to move slightly relative to the piston rod assembly 84. An annular shoulder 142 projects radially outwardly from the piston rod extension 138. A plurality of axially extending ribs 144 also extend radially outwardly from the piston rod extension 138. There is an axial spacing between the piston rod extension shoulder 142 and the ribs 144 that is slightly larger than the axial length of the air piston collar 136. This enables the air piston 132 to reciprocate axially on the piston rod extension 138 between the annular shoulder 142 and the ribs 144. When the air pump piston 132 moves relative to the piston rod extension 138 and engages with the ribs 144 in the position shown in FIG. 2, an air flow passage is established between the interior surface of the air piston collar 136 and the exterior surface of the piston rod extension 138. This enables the interior volume of the air pump chamber 118 to be vented to the exterior environment of the trigger sprayer 12. When the air pump piston 132 moves in the opposite direction and the piston annular end wall 134 engages against the piston rod extension shoulder 142, the air flow passage between the air piston collar 136 and the piston rod extension 138 is sealed closed. This prevents air flow between the exterior environment of the trigger sprayer 12 and the interior volume of the air pump chamber 118.

In the operation of the trigger sprayer 12 when the liquid pump chamber 38 has not yet been primed with liquid and air fills the chamber, manually squeezing the trigger 16 toward the sprayer housing 14 compresses the air in the liquid pump chamber 38. The compressed air is communicated through the liquid pump chamber outlet passage 58 to the exterior surface of the second sleeve valve 98. This causes the second sleeve valve 98 to move away from its sealing engagement with the small interior diameter portion 74 of the discharge passage opening the discharge passage. The air from the liquid pump chamber is pumped through the discharge passage and is dispensed from the trigger sprayer through the discharge nozzle 18. The pressure created in the liquid pump chamber 38 causes the peripheral portion of the disk valve 104 to seat against the circular seating surface 112 of the valve seat insert 28 preventing the compressed air from being pumped downward through the dip tube 32 and into the liquid container attached to the trigger sprayer.

Manually squeezing the trigger 16 also causes the piston rod extension 138 to move through the opening in the air piston collar 136 until the air piston annular end wall 134 seats against the piston rod shoulder 132. This seals closed the air pump chamber 118 and causes the air pump piston 132 to move toward its discharge position in the air pump chamber. This compresses the air in the air pump chamber 118. The compressed air in the air pump chamber 118 is communicated through the outlet passage 128 of the chamber to the exterior surface of the first sleeve valve 96. This causes the first sleeve valve 96 to move away from its sealing engagement with the larger interior diameter portion 72 of the discharge passage, opening the discharge passage. The air from the air pump chamber 118 is pumped through the discharge passage and mixed with the air from the liquid pump chamber 38. The air from both of these passages is dispensed from the trigger sprayer through the discharge nozzle 18.

On manually releasing the trigger 16 the coil spring 86 pushes the trigger away from the sprayer housing 14. This movement of the trigger pulls the liquid pump piston 82 outwardly through the liquid pump chamber 38 toward its charge position relative to the pump chamber. The removal of the air pressure on the exterior surface of the second sleeve valve 98 causes the resilient sleeve valve to move into sealing engagement with the small interior diameter portion 74 of the discharge passage. This creates a vacuum in the liquid pump chamber 38 that pulls the peripheral portion of the disk valve 104 out of engagement with the circular seating surface 112 of the valve seat insert 28 and draws liquid from the container up through the dip tube 32 and the liquid supply passage 42 into the interior of the liquid pump chamber 38.

The movement of the piston rod assembly 84 toward the charge position of the liquid pump piston 82 by the coil spring 86 also causes the piston rod extension 138 to move to the left as viewed in FIG. 2. For a small portion of the movement of the piston rod extension 138, the extension moves relative to the air piston collar 136 and the air pump piston 132. This causes the piston rod extension annular shoulder 142 to disengage from its sealing engagement with the air piston annular end wall 134. This again opens the vent path between the interior surface of the air piston collar 136 and the exterior surface of the piston rod extension 138. The relative movement of the piston rod extension 138 continues until the ribs 144 on the extension engage the collar 136 of the air piston. Further movement of the piston rod extension 138 causes the air pump piston 132 to move in the air pump chamber 118 toward its charge position relative to the air pump chamber. This creates a vacuum in the air pump chamber 118 that draws air from the exterior environment through the air flow path established between the air piston collar 136 and the piston rod extension 138 into the air pump chamber.

By subsequent manual squeezing of the trigger 16 toward the sprayer housing 14 the liquid in the liquid pump chamber 38 is forced through the pump chamber outlet passage 58 displacing the second sleeve valve 98 from its sealing engagement with the small interior diameter portion 74 of the discharge passage and forcing the liquid through the discharge passage to be dispensed from the discharge nozzle 18. The air pump piston rod extension 138 again moves relative to the air pump piston 132 causing the annular shoulder 142 of the rod extension to come into sealing contact with the annular end wall 134 of the air piston. This again seals closed the air flow path between the air piston collar 136 and the piston rod extension 138. Further movement of the trigger causes the piston rod extension 138 to push the air pump piston 132 toward the discharge position of the air piston in the air pump chamber 118. This compresses the air in the air pump chamber and forces the air through the air pump chamber outlet passage 128 displacing the first sleeve valve 96 from its sealing engagement with the large interior diameter portion 72 of the discharge passage. This causes the pressurized air to mix with the liquid flowing through the discharge passage, creating a foam that is dispensed from the discharge nozzle 18.

The construction of the valve member 26 with a pair of sleeve valves 96, 98 and disk valve 104 on a single component part of the trigger sprayer 12, and the construction of the coaxial liquid pump chamber 38 and air pump chamber 118 and the respective coaxial pistons 82, 132 enables the trigger sprayer 12 to be compactly constructed of a reduced number of separate component parts. The reduction in the total number of component parts needed to assemble the trigger sprayer reduces its manufacturing costs.

Although only one embodiment of the trigger sprayer of the invention has been described above, it should be understood that other modifications and variations could be made to the trigger sprayer without departing from the scope of the invention defined by the following claims.

What is claimed is:

1. A manually operated, liquid dispensing trigger sprayer comprising:

a sprayer housing;

a liquid pump on the sprayer housing, the liquid pump having a center axis;

an air pump on the sprayer housing, the air pump having a center axis, the air pump center axis being coaxial with the liquid pump center axis;

a liquid discharge passage extending through the sprayer housing and communicating with the liquid pump for directing liquid through the sprayer housing and discharging the liquid from the sprayer housing on operation of the liquid pump; and, a trigger mounted on the sprayer housing for movement of the trigger relative to the sprayer housing, the trigger being operatively connected to the liquid pump for operation of the liquid pump in response to movement of the trigger.

2. The trigger sprayer of claim 1, further comprising:

the liquid pump having a pump chamber with a cylindrical interior surface, and a pump piston mounted in the pump chamber for reciprocating movement relative to the pump chamber; and, the air pump having a pump chamber with a cylindrical interior surface, and an air piston mounted in the air pump chamber for reciprocating movement relative to the air pump chamber.

3. The trigger sprayer of claim 2, further comprising:

the liquid pump chamber being positioned inside the air pump chamber.

4. The trigger sprayer of claim 2, further comprising:

the air pump chamber extending round the liquid pump chamber.

5. The trigger sprayer of claim 2, further comprising:

the liquid pump piston being positioned inside the air pump piston.

6. The trigger sprayer of claim 2, further comprising:

the air pump piston extending around the liquid pump piston.

7. A manually operated liquid dispensing trigger sprayer comprising:

a sprayer housing;

a liquid pump chamber having a a pump chamber sidewall on the sprayer housing;

an air pump chamber having an air chamber sidewall on the sprayer housing, the air chamber sidewall extending around the pump chamber sidewall and surrounding the pump chamber;

a liquid discharge passage extending through the sprayer housing and communicating with the liquid pump chamber and the air pump chamber for directing liquid from the liquid pump chamber and air from the air pump chamber through the sprayer housing, and discharging the liquid mixed with the air from the sprayer housing;

a liquid pump piston mounted in the liquid pump chamber for reciprocating movement of the liquid pump piston in the liquid pump chamber;

an air pump piston mounted in the air pump chamber for reciprocating movement of the air pump piston in the air pump chamber; and, a trigger mounted on the sprayer housing for movement of the trigger relative to the sprayer housing, the trigger being operatively connected to the liquid pump piston and the air pump piston for reciprocating movement of the liquid pump piston and the air pump piston in the respective liquid pump chamber and air pump chamber in response to movement of the trigger.

8. The trigger sprayer of claim 7, further comprising:

the liquid pump chamber sidewall having a cylindrical interior surface with a center axis;

the air pump chamber sidewall having a cylindrical interior surface with a center axis; and, the liquid pump chamber center axis being coaxial with the air pump chamber center axis.

9. The trigger sprayer of claim 7, further comprising:

the liquid pump piston being positioned inside the air pump piston.

10. The trigger sprayer of claim 7, further comprising:

the air pump piston extending around and surrounding the liquid pump piston.

11. The trigger sprayer of claim 7, further comprising:

the liquid pump piston being cylindrical and having a center axis;

the air pump piston being cylindrical and having a center axis; and, the liquid pump piston and the air pump piston being coaxial.

12. The trigger sprayer of claim 7, further comprising:

the trigger having a length with opposite proximal and distal ends, the trigger proximal end being mounted to the sprayer housing for movement of the trigger relative to the sprayer housing, and the trigger length projecting from the sprayer housing to the trigger distal end.

13. A manually operated liquid dispensing trigger sprayer comprising:

a sprayer housing;

a liquid pump chamber on the sprayer housing;

an air pump chamber on the sprayer housing;

a liquid discharge passage communicating with the liquid pump chamber and the air pump chamber and extending through the sprayer housing for directing liquid from the liquid pump chamber and air from the air pump chamber through the sprayer housing, and discharging the liquid mixed with the air from the sprayer housing;

a liquid pump piston mounted in the liquid pump chamber for reciprocating movement of the liquid pump piston in the liquid pump chamber, the liquid pump piston being cylindrical and having a center axis;

an air pump piston mounted in the air pump chamber for reciprocating movement of the air pump piston in the air pump chamber, the air pump piston being cylindrical and having a center axis that is coaxial with the liquid pump piston center axis; and, a trigger mounted on the sprayer housing for movement of the trigger relative to the sprayer housing, the trigger being operatively connected to the liquid pump piston and the air pump piston for reciprocating movement of the liquid pump piston and the air pump piston in the respective liquid pump chamber and air pump chamber in response to movement of the trigger.

14. The trigger sprayer of claim 13, further comprising:

the liquid pump piston being positioned inside the air pump piston.

15. The trigger sprayer of claim 13, further comprising:

the air pump piston extending around and surrounding the liquid pump piston.

16. The trigger sprayer of claim 13, further comprising:

the liquid pump chamber being positioned inside the air pump chamber.

17. A manually operated trigger sprayer comprising:

a sprayer housing having a liquid outlet opening and a liquid inlet opening in the sprayer housing, a liquid pump chamber in the sprayer housing, an air pump chamber in the sprayer housing, a discharge passage extending through the sprayer housing from the liquid pump chamber and the air pump chamber to the liquid outlet opening and a liquid supply passage extending through the sprayer housing from the liquid inlet opening to the liquid pump chamber;

a liquid pump piston and an air pump piston mounted in the respective liquid and air pump chambers for reciprocating movement between charge and discharge positions of the liquid and air pump pistons in the respective liquid and air pump chambers; and, a unitary valve member in the sprayer housing having an inlet valve element and a pair of outlet valve elements, the inlet valve element being positioned in the liquid supply passage and being movable between a closed position closing the liquid supply passage and an opened position opening the liquid supply passage in response to the pump piston moving to the discharge and charge positions, respectively, and first and second outlet valve elements being positioned in the discharge passage and being movable between closed positions closing the discharge passage and opened positions opening the discharge passage in response to the liquid and air pump pistons moving to the charge and discharge positions, respectively.

18. The trigger sprayer of claim 17, further comprising:

the outlet valve elements being tubes.

19. The trigger sprayer of claim 17, further comprising:

the inlet valve element being a disk.

20. The trigger sprayer of claim 17, further comprising:

the inlet valve element being a disk and the outlet valve elements being tubes.

* * * * *